US011830654B2

(12) United States Patent
Kim et al.

(10) Patent No.: US 11,830,654 B2
(45) Date of Patent: Nov. 28, 2023

(54) COIL ELECTRONIC COMPONENT

(71) Applicant: SAMSUNG ELECTRO-MECHANICS CO., LTD., Suwon-si (KR)

(72) Inventors: Yong Min Kim, Suwon-si (KR); Jae Hun Kim, Suwon-si (KR); Ji Hyuk Lim, Suwon-si (KR); Jong Yun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 922 days.

(21) Appl. No.: 16/696,663

(22) Filed: Nov. 26, 2019

(65) Prior Publication Data

US 2020/0402699 A1 Dec. 24, 2020

(30) Foreign Application Priority Data

Jun. 21, 2019 (KR) ..... 10-2019-0073984

(51) Int. Cl.
*H01F 27/28* (2006.01)
*H01F 27/29* (2006.01)

(52) U.S. Cl.
CPC ..... *H01F 27/2804* (2013.01); *H01F 27/29* (2013.01); *H01F 2027/2809* (2013.01)

(58) Field of Classification Search
CPC ..... H01F 27/2804; H01F 27/29; H01F 2027/2809; H01F 2017/048; H01F 17/0013; H01F 17/04; H01F 27/292; H01F 27/022; H01F 27/28; H01F 27/306; H01F 5/04; H01F 17/02
USPC ..... 336/192, 200, 232, 198
See application file for complete search history.

(56) References Cited

U.S. PATENT DOCUMENTS

2015/0102891 A1 4/2015 Yoon et al.
2016/0172103 A1* 6/2016 Jeong ..... H01F 17/04 29/605
2016/0189840 A1* 6/2016 Ahn ..... H01F 17/04 29/602.1
2017/0178798 A1* 6/2017 Yoon ..... H01F 17/0013
(Continued)

FOREIGN PATENT DOCUMENTS

KR 10-2014-0038780 A 3/2014
KR 10-2015-0044372 A 4/2015
KR 10-2015-0105691 A 9/2015
(Continued)

OTHER PUBLICATIONS

Korean Office Action dated May 12, 2020 issued in Korean Patent Application No. 10-2019-0073984 (with English translation).

*Primary Examiner* — Shawki S Ismail
*Assistant Examiner* — Kazi S Hossain
(74) *Attorney, Agent, or Firm* — Morgan, Lewis & Bockius LLP

(57) ABSTRACT

A coil electronic component includes an insulating substrate, a coil portion disposed on at least one surface of the insulating substrate, a body in which the insulating substrate and the coil portion are embedded, a lead-out portion connected to the coil portion and exposed to an external surface of the body, and a protrusion embedded in the body to be connected to the lead-out portion, and spaced apart from the external surface of the body and each of the coil portion.

19 Claims, 8 Drawing Sheets

(56) References Cited

U.S. PATENT DOCUMENTS

| | | | | |
|---|---|---|---|---|
| 2018/0286561 | A1* | 10/2018 | Shimoichi | H01F 41/10 |
| 2020/0090853 | A1* | 3/2020 | Yang | H01F 27/29 |

FOREIGN PATENT DOCUMENTS

| | | | |
|---|---|---|---|
| KR | 10-2016-0071958 | A | 6/2016 |
| KR | 10-1670184 | B1 | 10/2016 |
| KR | 10-2018-0012621 | A | 2/2018 |

* cited by examiner

COIL ELECTRONIC COMPONENT

CROSS-REFERENCE TO RELATED APPLICATION(S)

This application claims the benefit under 35 USC 119(a) of priority to Korean Patent Application No. 10-2019-0073984 filed on Jun. 21, 2019 in the Korean Intellectual Property Office, the entire disclosure of which is incorporated herein by reference.

TECHNICAL FIELD

The present disclosure relates to a coil electronic component.

BACKGROUND

The present disclosure relates to a coil electronic component.

Inductors, coil components, are representative passive elements used for electronic devices, together with resistors and capacitors. As electronic devices have been increasingly multifunctionalized and miniaturized, the number of electronic components used in electronic devices has been increasing, while becoming smaller in size.

However, as a thinned coil component is manufactured, external force or the like may be applied to a portion thereof in which the coil portion and the external electrode are connected, thereby reducing connection reliability and structural rigidity between the conductor and the body.

SUMMARY

This Summary section is provided to introduce a selection of concepts in a simplified form that are further described below in the Detailed Description. This section is not intended to identify key features or essential features of the claimed subject matter, nor is it intended to be used as an aid in determining the scope of the claimed subject matter.

An aspect of the present disclosure is to provide a coil electronic component in which connection reliability and structural rigidity of a portion in which a coil portion and an external electrode are connected are increased.

According to an aspect of the present disclosure, a coil electronic component includes an insulating substrate, a coil portion disposed on at least one surface of the insulating substrate, a body in which the insulating substrate and the coil portion are embedded, a lead-out portion connected to the coil portion and exposed to an external surface of the body, and a protrusion embedded in the body to be connected to the lead-out portion, and spaced apart from the external surface of the body and the coil portion.

According to another aspect of the present disclosure, a coil electronic component includes a body having both end surfaces, opposing each other in a length direction of the body, and one surface connecting the both end surfaces to each other; an insulating substrate disposed in the body; a coil portion disposed on at least one surface of the insulating substrate; a lead-out portion connected to the coil portion and exposed to the both end surfaces in the length direction and the one surface of the body in a thickness direction of the body; and a protrusion embedded in the body to be connected to the lead-out portion, and spaced apart from the both end surfaces and the one surface of the body and from the coil portion.

According to still another aspect of the present disclosure, a coil electronic component includes an insulating substrate; a coil portion disposed on at least one surface of the insulating substrate; and a body in which the insulating substrate and the coil portion are embedded, wherein the coil portion includes first and second lead-out portions at both ends of the coil portion, respectively, at least portions of the first and second lead-out portions are exposed to first and second surfaces of the body, respectively, opposing each other, and at least one end of each of the first and second lead-out portions protrudes inwardly of the body from a respective surface of the first and second surfaces to be spaced apart therefrom.

According to yet another aspect of the present disclosure, a coil electronic component includes a body having first and second surfaces, opposing each other, and a third surface connecting the first and second surfaces to each other; an insulating substrate; and a coil portion disposed on at least one surface of the insulating substrate, wherein the insulating substrate and the coil portion are embedded in the body, the coil portion includes first and second lead-out portions at both ends of the coil portion, respectively, the first lead-out portion is exposed to the first and third surfaces of the body, and the second lead-out portion is exposed to the second and third surfaces of the body, at least one end of the first lead-out portion protrudes inwardly of the body from the first surface or the third surface to be spaced apart therefrom, and at least one end of the second lead-out portion protrudes inwardly of the body from the second surface or the third surface to be spaced apart therefrom.

BRIEF DESCRIPTION OF DRAWINGS

Throughout the drawings and the detailed description, the same reference numerals refer to the same elements. The drawings may not be to scale, and the relative size, proportions, and depictions of elements in the drawings may be exaggerated for clarity, illustration, and convenience.

DETAILED DESCRIPTION

Figure 1:
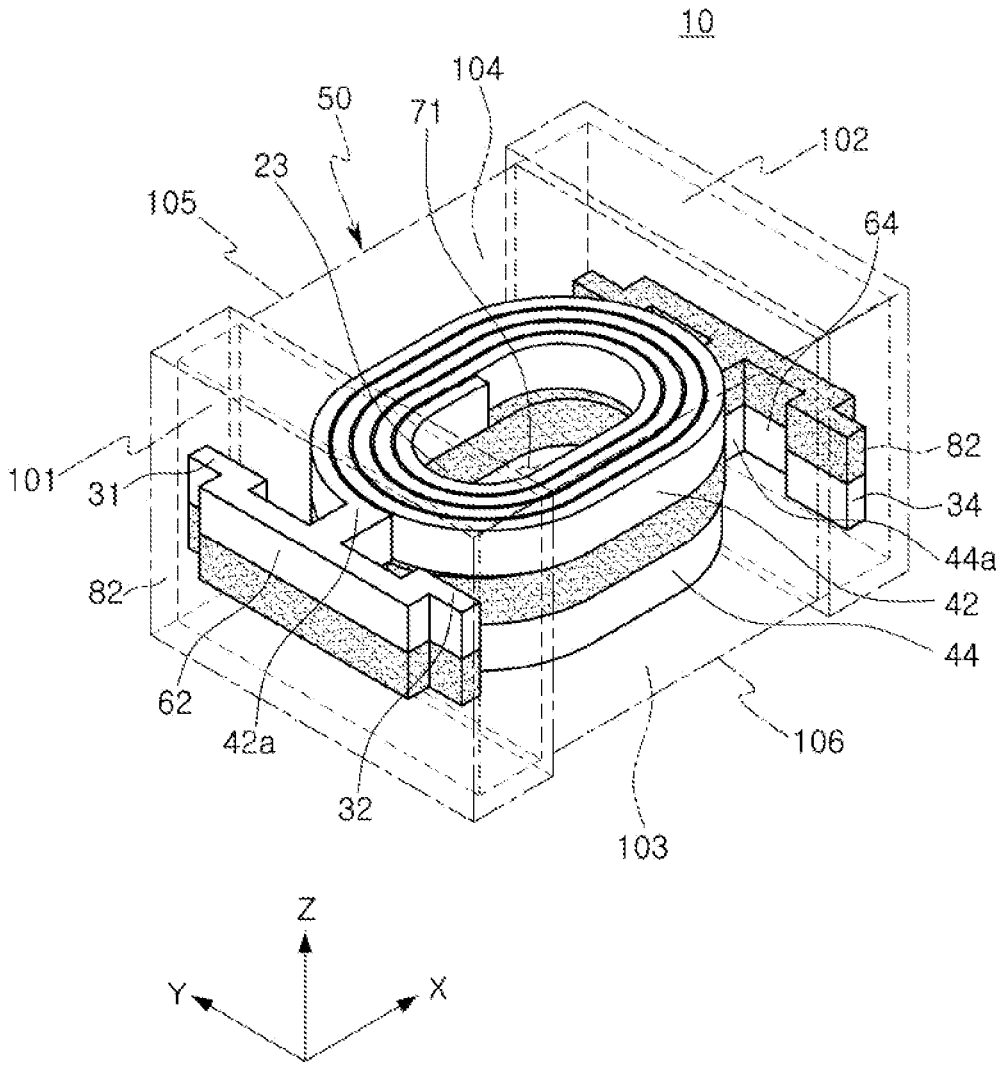
FIG. 1 is a perspective view schematically illustrating a coil electronic component according to a first exemplary embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed, as will be apparent to one of ordinary skill in the art, with the exception of operations necessarily occurring in a certain order. Also, descriptions of functions and constructions that would be well known to one of ordinary skill in the art may be omitted for increased clarity and conciseness.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "including", "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Throughout the specification, it will be understood that when an element, such as a layer, region or wafer (substrate), is referred to as being "on," "connected to," or "coupled to" another element, it may be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

The drawings may not be to scale, and the relative size, proportions, and depiction of elements in the drawings may be exaggerated for clarity, illustration, and convenience.

Hereinafter, embodiments of the present disclosure will be described with reference to various embodiments. However, the embodiments of the present disclosure can be modified into various other forms, and the scope of the present disclosure is not limited to the embodiments described below.

In the drawings, the X direction may be defined as a first direction or a length direction, the Y direction as a second direction or a width direction, and the Z direction as a third direction or a thickness direction.

Hereinafter, a coil electronic component according to various exemplary embodiments of the present disclosure will be described in detail with reference to the accompanying drawings. Referring to the accompanying drawings, the same or corresponding components are denoted by the same reference numerals, and duplicate descriptions thereof will be omitted.

Various kinds of electronic components are used in an electronic device, and various kinds of coil components may be appropriately used between these electronic components, for removal of noise.

For example, in an electronic device, a coil electronic component may be used as a power inductor, a high frequency (HF) inductor, a general bead, a high frequency (GHz) bead, a common mode filter, or the like.

First Embodiment

Figure 2:
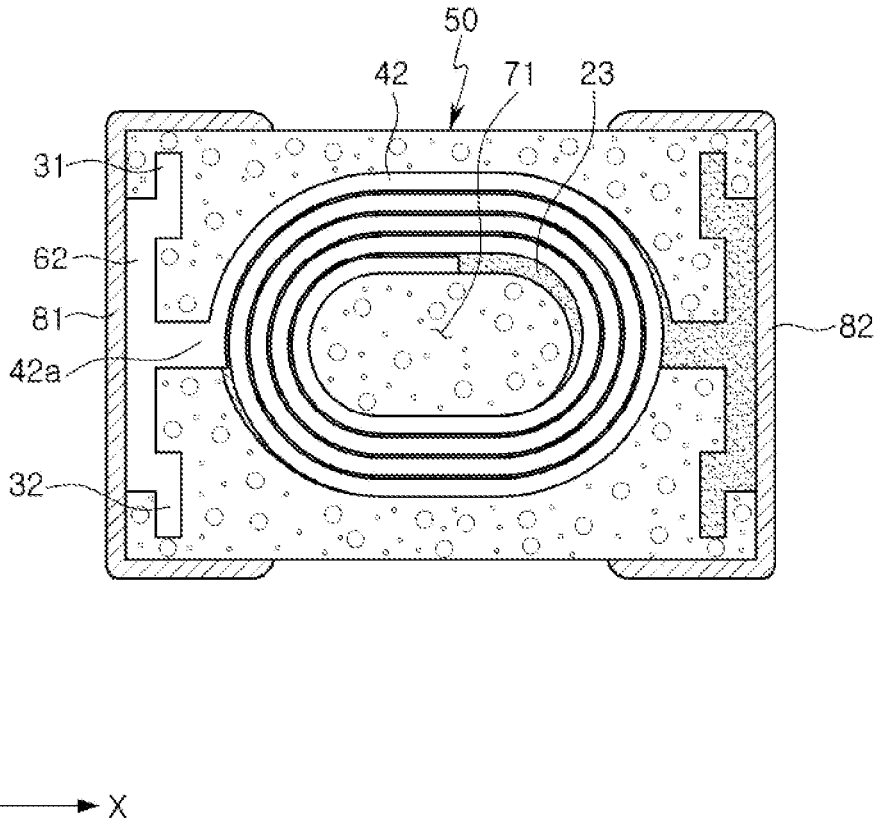
FIG. 2 is a view illustrating a coil portion of the coil electronic component of FIG. 1 as viewed from above.

FIG. 1 is a perspective view schematically illustrating a coil electronic component according to a first exemplary embodiment of the present disclosure. FIG. 2 is a view illustrating coil portions of the coil electronic component of FIG. 1 as viewed from above.

Referring to FIGS. 1 and 2, a coil electronic component 10 according to a first exemplary embodiment of the present disclosure may include an insulating substrate 23, coil portions 42 and 44, a body 50, lead-out portions 62 and 64, and protrusions 31 and 32, and may further include external electrodes 81 and 82.

The insulating substrate 23 is disposed inside the body 50 to be described later, and supports the coil portions 42 and 44 and the lead-out portions 62 and 64.

The insulating substrate 23 may be formed of an insulating material including a thermosetting insulating resin such as an epoxy resin, a thermoplastic insulating resin such as polyimide or a photoimageable dielectric resin, or may be formed of an insulating material in which this insulating resin is impregnated with a reinforcing material such as a glass fiber or an inorganic filler. As an example, the insulating substrate 23 may be formed of an insulating material such as prepreg, Ajinomoto Build-up Film (ABF), FR-4, bismaleimide triazine (BT) film, and a Photo Imageable Dielectric (PID) film, or the like, but a material thereof is not limited thereto.

As the inorganic filler, one or more selected from the group consisting of silica ($SiO_2$), alumina ($Al_2O_3$), silicon carbide (SiC), barium sulphate ($BaSO_4$), talc, mud, mica powder, aluminum hydroxide ($AlOH_3$), magnesium hydroxide ($Mg(OH)_2$) calcium carbonate ($CaCO_3$), magnesium carbonate ($MgCO_3$), magnesium oxide (MgO), boron nitride (BN), aluminum borate ($AlBO_3$), barium titanate ($BaTiO_3$) and calcium zirconate ($CaZrO_3$) may be used.

For example, when the insulating substrate 23 is formed of an insulating material including a reinforcing material, the insulating substrate 23 may provide relatively excellent rigidity. When the insulating substrate 23 is formed of an insulating material not containing a glass fiber, the insulating substrate 23 may be advantageous in terms of thinning the thickness of entirety of the coil portions 42 and 44.

The insulating substrate 23 may be provided with a through-hole formed by penetrating through a central portion thereof, and the through-hole may be filled with a magnetic material of the body 50 to be described later to form a core portion 71. As such, by forming the core portion 71 filled with the magnetic material, performance of an inductor may be improved.

The coil portions 42 and 44 are disposed on at least one surface of the insulating substrate 23 to exhibit characteristics of the coil electronic component. For example, when the coil electronic component 10 according to this embodiment is used as a power inductor, the coil portions 42 and 44 may serve to stabilize the power supply of an electronic device by storing an electric field as a magnetic field to maintain an output voltage.

In this embodiment, the coil portions 42 and 44 (a first coil portion 42 and a second coil portion 44) are disposed on both surfaces of the insulating substrate 23 opposing each other, respectively. For example, the first coil portion 42 may be disposed on one surface of the insulating substrate 23 to face the second coil portion 44 disposed on the other surface of the insulating substrate 23. The first and second coil portions 42 and 44 may be electrically connected to each other through a via electrode (not illustrated) penetrating through the insulating substrate 23. Each of the first coil portion 42 and the second coil portion 44 may have a planar spiral shape in which at least one turn is formed around the core portion 71. For example, the first coil portion 42 may form at least one turn about the core portion 71 as an axis on one surface of the insulating substrate 23.

The body 50 forms the appearance of the coil electronic component 10 according to this embodiment, and includes the insulating substrate 23 and the coil portions 42 and 44 embedded therein.

The body 50 may be formed to have the shape of a hexahedron overall.

The body 50 has a first surface 101 and a second surface 102 opposing each other in a length direction X, a third surface 103 and a fourth surface 104 opposing each other in a thickness direction Z, and a fifth surface 105 and a sixth surface 106 opposing each other in a width direction Y, with reference to FIG. 1. Hereinafter, the first and second surfaces 101 and 102 of the body 50 may also be referred to as both end surfaces of the body 50, and the third surface 103 of the body 50 may be referred to as one surface of the body 50.

In the case of the coil electronic component 10 according to an exemplary embodiment of the present disclosure including the external electrodes 81 and 82 to be described later, by way of example, the body 50 may be formed to have a length of 0.2±0.1 mm, a width of 0.25±0.1 mm, and a thickness of 0.4 mm, but an exemplary embodiment thereof is not limited thereto.

The body 50 may include a magnetic material and an insulating resin. In detail, the body 50 may be formed by laminating one or more magnetic sheets containing an insulating resin and a magnetic material dispersed in the insulating resin. The body 10 may also have a structure other than the structure in which the magnetic material is dispersed in the insulating resin. For example, the body 50 may be formed of a magnetic material such as ferrite.

The magnetic material may be ferrite or a magnetic metal powder. The ferrite powder may be at least one of spinel type ferrites such as Mg—Zn type, Mn—Zn type, Mn—Mg type, Cu—Zn type, Mg—Mn—Sr type, Ni—Zn type and the like, hexagonal ferrites such as Ba—Zn type, Ba—Mg type, Ba—Ni type, Ba—Co type, Ba—Ni—Co type and the like, garnet type ferrites such as a Y system and the like, and Li-based ferrites. In addition, the magnetic metal powder included in the body 50 may include iron (Fe), silicon (Si), chromium (Cr), cobalt (Co), molybdenum (Mo), aluminum (Al), niobium (Nb), copper (Cu), nickel (Ni), and alloys thereof. For example, the magnetic metal powder may be at least one of pure iron powder, an Fe—Si-based alloy powder, an Fe—Si—Al based alloy powder, an Fe—Ni based alloy powder, an Fe—Ni—Mo based alloy powder, an Fe—Ni—Mo—Cu based alloy powder, an Fe—Co based alloy powder, an Fe—Ni—Co based alloy powder, an Fe—Cr based alloy powder, an Fe—Cr—Si based alloy powder, an Fe—Si—Cu—Nb based alloy powder, an Fe—Ni—Cr based alloy powder, and an Fe—Cr—Al based alloy powder. In this case, the magnetic metal powder may be amorphous or crystalline. For example, the magnetic metal powder may be a Fe—Si—B—Cr amorphous alloy powder, but is not limited thereto. The ferrite particle particles and the magnetic metal powder particles may each have an average diameter of about 0.1 μm to 30 μm, but exemplary embodiments thereof are not limited thereto.

The body 50 may include two or more kinds of magnetic materials dispersed in an insulating resin. In this case, different kinds of magnetic materials mean that the magnetic materials dispersed in the insulating resin are distinguished from each other by any one of an average diameter, a composition, crystallinity and a shape. The insulating resin may include, but is not limited to, an epoxy, polyimide, a liquid crystal polymer, or the like, alone or in combination, but is not limited thereto.

The lead-out portions 62 and 64 are connected to the coil portions 42 and 44 to be exposed to the surface of the body 50.

Referring to FIG. 1, one end of the first coil portion 42 formed on one surface of the insulating substrate 23 is extended to form a first lead-out portion 62, and the first lead-out portion 62 may be exposed to the first surface 101 of the body 50. In addition, one end of the second coil portion 44 is extended to the other surface of the insulating substrate 23 opposing one surface of the insulating substrate 23 to form a second lead-out portion 64, and the second lead-out portion 64 may be exposed to the second surface 102 of the body 50.

Referring to FIGS. 1 and 2, the external electrodes 81 and 82 and the coil portions 42 and 44 may be connected to each other through the lead-out portions 62 and 64.

First, second, third, and fourth protrusions 31, 32, 33 and 34 are embedded in the body 50, are connected to the lead-out portions 62 and 64, and are spaced apart from the external surface of the body 50 and the coil portions 42 and 44, respectively. Hereinafter, for convenience of description, first and second protrusions 31 and 32 will be mainly described, but the description of the first and second protrusions 31 and 32 may be applied to third and fourth protrusions 33 and 34 as it is.

In this embodiment, the first and second protrusions 31 and 32 are connected to the first lead-out portion 62 and are integrally formed with the first lead-out portion 62. The third and fourth protrusions 33 and 34 are connected to the second lead-out portion 64 and are integrally formed with the second lead-out portion 64. For example, since the protrusions 31, 32, 33 and 34 are connected to the lead-out portions 62 and 64, the protrusions 31, 32, 33 and 34 may include the same conductive metal as the lead-out portions 62 and 64.

According to this embodiment, a length of each of the lead-out portions 62 and 64, in the width direction Y, exposed to both end surfaces (e.g., the first and second surfaces 101 and 102) of the body 50 may be smaller than a width of the body 50.

Referring to FIG. 2, the first and second protrusions 31 and 32 are connected to the first lead-out portion 62 and are embedded in an anchor shape inside the body 50. For example, the first and second protrusions 31 and 32 are firmly fixed to the body 50 on the remaining surfaces thereof except for the surface connected to the first lead-out portion 62, to improve bonding strength between the first lead-out portion 62 and the body 50.

Referring to FIG. 2, the first and second protrusions 31 and 32 are spaced apart from all external surfaces of the body 50, respectively. In other words, the first and second protrusions 31 and 32 are not exposed to the external surface of the body 50. The first and second protrusions 31 and 32 may be respectively spaced apart from the first and second surfaces 101 and 102 opposed in the length direction X, the fifth and sixth surfaces 105 and 106 opposed in the width direction Y, and the third and fourth surfaces 103 and 104 opposed in the thickness direction Z, to be completely embedded in the body 50. In addition, the first and second protrusions 31 and 32 are spaced apart from the first coil portion 42 and are not connected to an end portion 42*a* of the first coil portion. Although not illustrated in detail, the third and fourth protrusions 33 and 34 are spaced apart from the second coil portion 44 and are not connected to an end portion 44*a* of the second coil portion 44.

If coupling force between the coil portions 42 and 44 and the external electrodes 81 and 82 to be described later is relatively weak, desorption may occur due to external shock such as heat or the like. Accordingly, there may be a problem in which electrical resistance is greatly increased or an open defect occurs in a connection region between the coil portions 42 and 44 and the external electrodes 81 and 82. The problem of weakening of the coupling force may be relatively increased as the chip size decreases and the area in which the lead-out portions 62 and 64 and the external electrodes 81 and 82 join the body 50 thus decreases.

In this embodiment, mechanical adhesion between the lead-out portions 62 and 64 and the body 50 may be improved within the same size, through the protrusions 31, 32, 33 and 34, spaced apart from the end portions 42*a* and 44*a* of the coil portions 42 and 44 and the external surface of the body 50 to be connected to the lead-out portions 62 and 64.

Referring to FIG. 2, only a portion of the first external electrode 81 contacts the first lead-out portion 62. For example, in this embodiment, the first lead-out portion 62 is only exposed to a portion of an external surface of the body 50 in contact with the first external electrode 81. In detail, based on FIG. 2, the first lead-out portion 62 is only exposed to a portion of the first surface 101 of the body 50, and does not extend to the fifth and sixth surfaces 105 and 106 of the body 50, on which the first external electrode 81 is formed. Based on FIG. 2, in a case in which the first lead-out portion 62 extends to the fifth and sixth surfaces 105 and 106 of the body 50 on which the first external electrode 81 is formed, coupling force between the first lead-out portion 62 and the first external electrode 81 may increase, but the volume of the first lead portion 62 in the body 50 increases, such that the volume of a magnetic body within the same body size may not be increased. Therefore, in this embodiment, the first lead-out portion 62 is exposed to only a portion of the first surface 101 of the body 50 to increase the volume of the magnetic body in the body 50. In this case, as described above, coupling force between the body 50 and the first lead-out portion 62 and further, coupling force between the body 50 and the first external electrode 81 may be relatively reduced, but in this embodiment, the occurrence of the problem may be prevented by using the first and second protrusions 31 and 32.

The protrusions 31, 32, 33 and 34 have a structure in which all surfaces thereof except for surfaces connected to the lead-out portions 62 and 64 are surrounded by a magnetic material. As described above, since the protrusions 31, 32, 33 and 34 are spaced apart from the external surface of the body 50 and the coil portions 42 and 44, all the surfaces of the protrusions 31, 32, 33 and 34, except for surfaces thereof connected to the lead-out portions 62 and 64, are surrounded by a magnetic material of the body 50. For example, all the surfaces of the protrusions 31, 32, 33 and 34, except for the surfaces connected to the lead-out portions 62 and 64, are completely embedded in the body 50. As a result, even in a case in which the area in which the lead-out portions 62 and 64 and the external electrodes 81 and 82 are in contact with the body 50 is reduced, the coupling force between the lead-out portions 62 and 64 and the body 50 may be improved (anchoring effect).

The protrusions 31, 32, 33 and 34 have a structure in which they are disposed on at least one of ends of the lead-out portions 62 and 64 in the width direction Y of the body 50. Referring to FIG. 2, the first lead-out portion 62 extends to the external surface of the body 50 in the width direction Y, and has the first and second protrusions 31 and 32 on both ends thereof in the width direction Y. Accordingly, the first lead-out portion 62 has a structure substantially extending in the width direction Y of the body 50 by the length protruding by the first and second protrusions 31 and 32. In addition, a portion in which the first lead-out portion 62 and the first and second protrusions 31 and 32 are connected in the width direction Y may have a thickness greater than a thickness of each of the first lead-out portion 62 or the first and second protrusions 31 and 32. The protrusions 31, 32, 33 and 34 may be disposed on any portion of the lead-out portions 62 and 64 extending in the width direction Y without any limitation, as long as the protrusions are spaced apart from the body 50 and the coil portions 42 and 44 to improve the bonding force thereof to the inside of the body 50.

The protrusions 31, 32, 33 and 34 may be a plurality of protrusions. Referring to FIG. 2, although the first and second protrusions 31 and 32 connected to the first lead-out portion 62 are two in total, the first and second protrusions 31 and 32 may be singular or two or more in number without being limited thereto, as long as coupling force between the body 50 and the lead portions 62 and 64 is increased thereby.

Referring to FIG. 2, the first protrusion 31 may be disposed on a position corresponding to a position of the second protrusion 32. As an example, since the first and second protrusions 31 and 32 are disposed on ends of the first lead-out portion 62 in the width direction Y of the body 50, respectively, the first protrusion 31 and the second protrusion 32 may be formed to correspond to each other.

For example, when the protrusions 31, 32, 33 and 34 are provided as a plurality of protrusions, the shape thereof is not limited, but the protrusions 31, 32, 33 and 34 may be formed to be symmetrical, to secure structural rigidity between the coil portions 42 and 44 and the external electrodes 81 and 82. As an example, the first and second protrusions 31 and 32 connected to the first lead-out portion 62 may be symmetrical with each other in the width direction Y, and the third and fourth protrusions 33 and 34 connected to the second lead-out portion 64 may also be symmetrical with each other in the width direction Y. To secure structural rigidity between the coil portions 42 and 44 and the external electrodes 81 and 82, the first and third protrusions 31 and 33 may also be symmetrical with each other in the length direction X, and the second and fourth protrusions 32 and 34 may also be symmetrical with each other in the length direction X.

The protrusions 31, 32, 33 and 34 are spaced apart from the external electrodes 81 and 82, which will be described later. As described above, the protrusions 31, 32, 33 and 34 are embedded in the body 50 while being spaced apart from the external surface of the body 50. Referring to FIG. 2, since the first external electrode 81 is bonded to the external surface of the body 50, the first and second protrusions 31 and 32 may also be spaced apart from the first external electrode 81 by a distance at which the first and second protrusions 31 and 32 are spaced apart from the external surface of the body 50.

In this embodiment, the coil portions 42 and 44 and the protrusions 31, 32, 33 and 34 are spaced apart from each other, but are electrically connected to each other via the lead-out portions 62 and 64. The coil portions 42 and 44, the protrusions 31, 32, 33 and 34, and the lead-out portions 62 and 64 may be formed together in the same process to be integrally formed with each other. The first lead-out portion 62 is connected to the first and second protrusions 31 and 32 connected to the end portion 42*a* of the first coil portion 42, and the second lead-out portion 64 is connected to the third and fourth protrusions 33 and 34 connected to the end portion 44*a* of the second coil portion 44.

The protrusions 31, 32, 33 and 34 may be manufactured by patterning and etching processes known in the art, and may also be naturally formed in the process of forming the coil portions 42 and 44 by plating or the like. As an example, the coil portions 42 and 44, the lead-out portions 62 and 64, the connection portions 31 and 32, and the protrusions 31, 32, 33 and 34 may be formed without separating the processes, by placing a different material in a region except for regions in which the coil portions 42 and 44, the lead-out portions 62 and 64, the connection portions 31 and 32, and the protrusions 31, 32, 33 and 34 are to be formed, in advance. In this case, a plating resist for formation of the coil portions 42 and 44, the connection portions 31 and 32, and the lead-out portions 62 and 64 is integrally formed, such that the protrusions 31, 32, 33 and 34 and the lead-out portions 62 and 64 may be plated together when the coil portions 42 and 44 are plated. In the case of forming the coil portions 42 and 44 and the lead-out portions 62 and 64 by performing the plating process, the thickness of the lead-out portions 62 and 64 may be appropriately adjusted by adjusting a current density, the concentration of a plating liquid, a plating speed, or the like. The lead-out portions 62 and 64 and the protrusions 31, 32, 33 and 34 may be obtained by various methods in addition to the method proposed in this embodiment.

The coil portions 42 and 44, the lead-out portions 62 and 64, the protrusions 31, 32, 33 and 34, and via electrodes (not illustrated) may be respectively formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Referring to FIGS. 1 and 2, the first and second external electrodes 81 and 82 are disposed on the external surface of the body 50 to cover the first and second lead-out portions 62 and 64, respectively. According to this embodiment, the external electrodes 81 and 82 may be disposed on the first and second surfaces 101 and 102 of the body 50 to cover the lead-out portions 62 and 64, while being partially extending to the third surface 103 and the fourth surface 104 of the body 50, connecting the first and second surfaces 101 and 102 to each other.

The external electrodes 81 and 82 may be formed by a thin film process such as a sputtering process, an electroplating process, or a printing method using a conductive resin. The external electrodes 81 and 82 may include at least one of copper (Cu), aluminum (Al), silver (Ag), tin (Sn), gold (Au), nickel (Ni), lead (Pb), chromium (Cr), titanium (Ti), and alloys thereof, as a conductive material, and may be implemented to have a multilayer structure.

Second Embodiment

Figure 3:
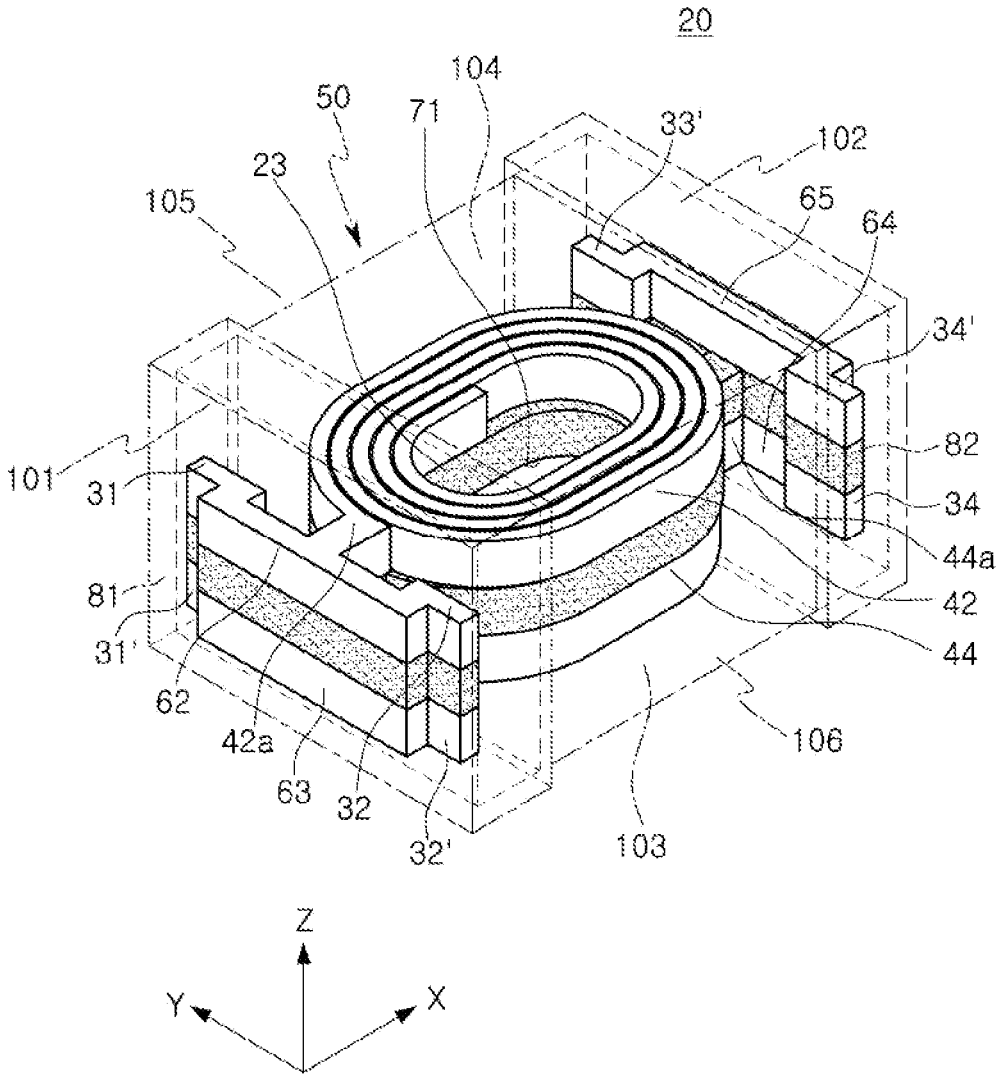
FIG. 3 is a perspective view schematically illustrating a coil electronic component according to a second exemplary embodiment.
Figure 4:
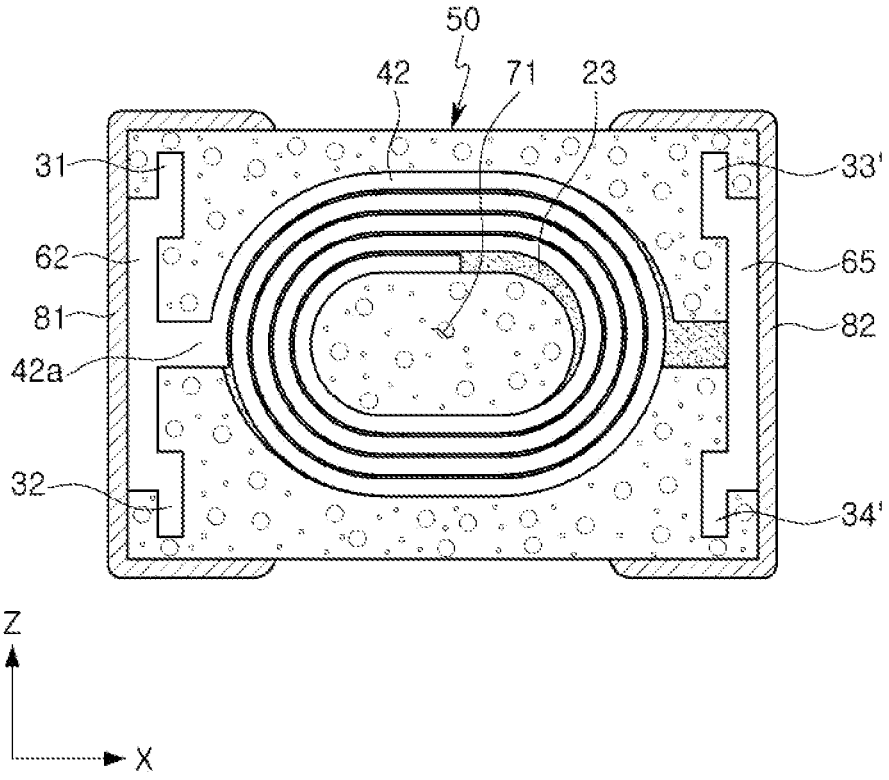
FIG. 4 is a view of a coil portion of the coil electronic component of FIG. 3, as viewed from above.

FIG. 3 is a perspective view schematically illustrating a coil electronic component according to a second exemplary embodiment of the present disclosure. FIG. 4 is a view of a coil portion of the coil electronic component of FIG. 3, viewed from above.

Referring to FIGS. 3 and 4, when compared to the coil electronic component 10 according to the first embodiment, the presence of auxiliary lead-out portions 63 and 65 is different. Therefore, in describing a coil electronic component 20 according to the second embodiment, only the presence or absence of the auxiliary lead-out portions 63 and 65 different from those of the first embodiment will be described. Descriptions of remaining configurations in this embodiment may be substituted with the descriptions of the first embodiment.

The auxiliary lead-out portions 63 and 65 (first and second auxiliary lead-out portions 63 and 65) are disposed on at least one surface of the insulating substrate 23 to correspond to the lead-out portions 62 and 64, respectively. In detail, the first auxiliary lead-out portion 63 is disposed on the other surface of the insulating substrate 23 and is formed to correspond to the first lead-out portion 62 disposed on one surface of the insulating substrate 23. The second auxiliary lead-out portion 65 may be disposed on one surface of the insulating substrate 23, and may be formed to correspond to the second lead-out portion 64 disposed on the other surface of the insulating substrate 23. By further including the auxiliary lead-out portions 63 and 65 having a symmetrical shape with the lead-out portions 62 and 64, the external electrodes 81 and 82 may be further symmetrically formed by plating in the coil electronic component 20 according to this embodiment. As a result, the coil electronic component 20 according to this embodiment may be more stably connected to a mounting substrate.

Referring to FIGS. 3 and 4, the first and second external electrodes 81 and 82 and the first and second coil portions 42 and 44 may be connected through the first and second lead-out portions 62 and 64 and the first and second auxiliary lead-out portions 63 and 65 disposed in the body 50. The auxiliary lead-out portions 63 and 65 may be electrically connected to the lead-out portions 62 and 64 by vias (not illustrated), and may be directly connected to the external electrodes 81 and 82. Since the auxiliary lead-out portions 63 and 65 are connected to the external electrodes 81 and 82, adhesion strength between the external electrodes 81 and 82 and the body 50 may be improved. The body 50 includes an insulating resin and a magnetic metal material, and the external electrodes 81 and 82 include a conductive metal, and thus are composed of different materials so that they do not tend to be mixed. Therefore, the auxiliary lead-out portions 63 and 65 are formed inside the body 50 to be exposed to the outside of the body 50, such that the external electrodes 81 and 82 and the auxiliary lead-out portions 63 and 65 may be additionally connected. Since the connection between the auxiliary lead-out portions 63 and 65 and the external electrodes 81 and 82 is a junction between a metal and a metal, the bonding force thereof is stronger than that between the body 50 and the external electrodes 81 and 82, such that adhesion strength of the external electrodes 81 and 82 to the body 50 may be improved.

Referring to FIG. 4, protrusions 31', 32', 33' and 34' are formed on the first and second auxiliary lead-out portions 63 and 65, respectively. Coupling force between the body 50 and the lead-out portions 62 and 64 and the auxiliary lead-out portions 63 and 65 may be improved through first and second protrusions 31' and 32' disposed on the first auxiliary lead-out portion 63, and third and fourth protrusions 33' and 34' disposed on the first auxiliary lead-out portion 65.

The auxiliary lead-out portions 63 and 65 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

Third Embodiment

Figure 5:
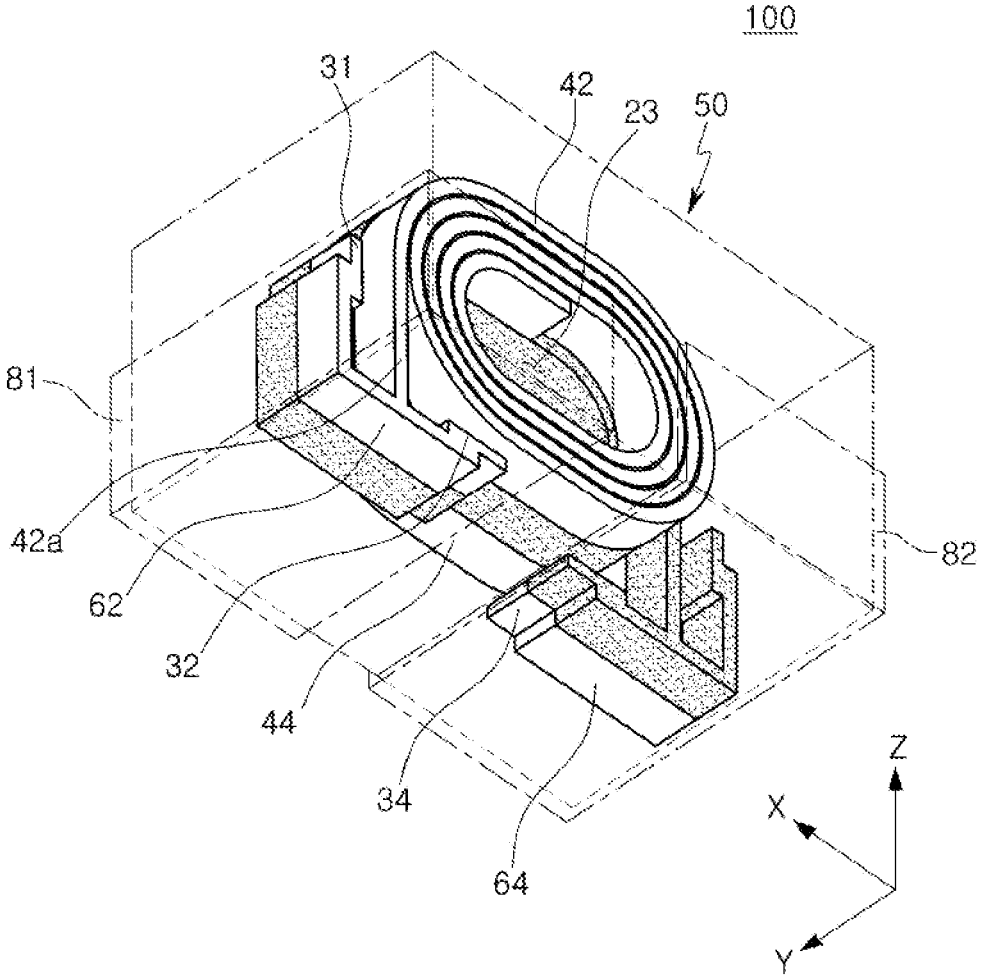
FIG. 5 is a view of a coil electronic component according to a third exemplary embodiment, viewed from below.
Figure 6:
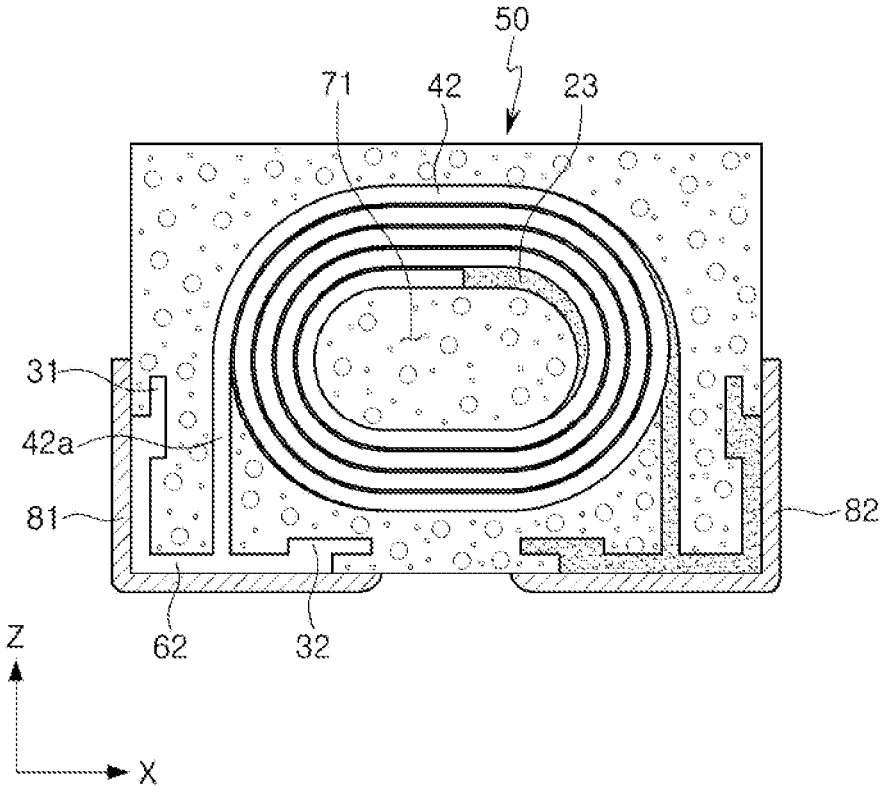
FIG. 6 is a front view of a coil portion of the coil electronic component of FIG. 5.

FIG. 5 is a view of a coil electronic component according to a third exemplary embodiment of the present disclosure, viewed from below. FIG. 6 is a front view of a coil portion of the coil electronic component of FIG. 3.

Referring to FIGS. 5 and 6, compared with the coil electronic component 10 according to the first embodiment, the arrangement of coil portions 42 and 44, lead-out portions 62 and 64, and protrusions 31, 32, 33 and 34, and external electrodes 81 and 82 is different. Therefore, in the description of a coil electronic component 100 according to the third embodiment, only the arrangement of the coil portions 42 and 44, the lead-out portions 62 and 64, the protrusions 31, 32, 33 and 34 and the external electrodes 81 and 82 different from those of the first embodiment will be described. Descriptions of remaining configurations in this embodiment may be substituted with the descriptions of the first embodiment.

Referring to FIGS. 5 and 6, the coil portions 42 and 44 may be formed to be upright with respect to the third surface 103 or the fourth surface 104 of the body 50.

The term "formed to be upright with respect to the third surface 103 or the fourth surface 104 of the body 50" refers to surfaces of the coil portions 42 and 44, contacting the insulating substrate 23 as illustrated in FIG. 3, being formed perpendicularly to or almost perpendicular to the third surface 103 or the fourth surface 104 of the body 50. For example, the coil portions 42 and 44 and the third surface 103 or the fourth surface 104 of the body 50 may be formed upright at 80 to 100°.

The coil portions 42 and 44 may be formed to be parallel to the fifth surface 105 and the sixth surface 106 of the body 50. For example, the surfaces of the coil portions 42 and 44, contacting the insulating substrate 23, may be parallel to the fifth surface 105 and the sixth surface 106 of the body 50.

As the body 50 is downsized to a size of 1608 or 1006 or less, the body 50 is formed to have a thickness greater than a width, and a cross-sectional area of an X-Z direction cross section of the body 50 is larger than a cross-sectional area of an X-Y direction cross-section. Thus, as the coil portions 42 and 44 are formed upright with respect to the third surface 103 or the fourth surface 104 of the body 50, an area in which the coil portions 42 and 44 may be formed increases.

For example, when the length of the body 50 is 1.6±0.2 mm and the width of the body 50 is 0.8±0.05 mm, the thickness may satisfy the range of 1.0±0.05 mm (1608 size). Further, when the length of the body 50 is 0.2±0.1 mm and the width of the body 50 is 0.25±0.1 mm, the thickness may satisfy the range of up to 0.4 mm (1006 size). Thus, since the thickness is greater than the width, when the coil portions 42 and 44 are formed vertically with respect to the third surface 103 or the fourth surface 104 of the body 50, a relatively large area may be secured, as compared with a case in which the coil portions 42 and 44 are formed horizontally with respect to the third surface 103 or the fourth surface 104 of the body 50. As the area in which the coil portions 42 and 44 are formed is increased, the inductance L and the quality factor Q may be improved.

According to this embodiment, the body 50 includes first and second surfaces 101 and 102 opposing each other, the third surface 103 and the fourth surface 104 connecting the first and second surfaces 101 and 102, and the lead-out portions 62 and 64 may be exposed to the third surface 103 of the body 50. The lead-out portions 62 and 64 are connected to the coil portions 42 and 44 to be exposed to the first and second surfaces 101 and 102 and the third surface 103 of the body 50. Referring to FIGS. 5 and 6, the first lead-out portion 62 is connected to the first coil portion 42 to be exposed to the first surface 101 and the third surface 103 of the body 50. The second lead-out portion 64 is connected to the second coil portion 44 to be exposed to the second surface 102 and the third surface 103 of the body 50.

As described above, structural rigidity of a connection portion between the coil portions 42 and 44 and the external electrodes 81 and 82 may be improved through the structure of the lead-out portions 62 and 64 disposed inside the body 50 and exposed to one surface of the body 50, even in thin and lightweight electronic components.

According to this embodiment, the protrusions 31, 32, 33 and 34 are spaced apart from the first and second surfaces 101 and 102 and the third surface 103 of the body 50. The protrusions 31, 32, 33 and 34 are respectively spaced apart from the first and second surfaces 101 and 102 opposed in the length direction X and the third and fourth surfaces 103 and 104 opposed in the thickness direction Z, to be completely embedded inside the body 50. Referring to FIG. 6, the entirety of one side surface of the lead-out portion 62 does not contact the main surfaces of the first to third surfaces 101, 102 and 103 of the body 50, but the lead-out portion 62 is embedded in the body 50 by lengths corresponding to the protrusions 31 and 32. For example, the protrusions 31, 32, 33 and 34 are embedded in the body 50 to improve the coupling force between the lead-out portions 62 and 64 and the body 50 (anchoring effect). As a result, the connection reliability and structural rigidity of the portion in which the coil portions 42 and 44 and the external electrodes 81 and 82 are connected, for example, the lead-out portions 62 and 64, may be increased.

The protrusions 31, 32, 33 and 34 are disposed on at least one of both ends of the lead-out portions 62 and 64 in the length direction X of the body 50 and the thickness direction Z of the body 50. Referring to FIG. 6, the lead-out portion 62 extends to the external surface of the body in the length direction X and the thickness direction Z, and includes first and second protrusions 31 and 32 on end portions of the lead-out portion 62, extending in the length direction X and the thickness direction Z. Accordingly, the first lead-out portion 62 has a structure substantially extending in the length direction X of the body 50 and in the thickness direction Z of the body 50 by the length protruding by the first and second protrusions 31 and 32. The protrusions 31, 32, 33 and 34 may be disposed on any portion of the lead-out portions 62 and 64 extending in the length direction X and in the thickness direction Z without any limitation, as long as the protrusions 31, 32, 33 and 34 are spaced apart from the body 50 and the coil portions 42 and 44 to improve the bonding force thereof to the inside of the body 50.

According to this embodiment, the external electrodes 81 and 82 are disposed on the third surface 103 of the body 50 and partially extend to the first and second surfaces 101 and 102, to cover the lead-out portions 62 and 64, respectively.

Referring to FIGS. 5 and 6, the external electrodes 81 and 82 may be disposed to be narrower than the width of the body 50. The first external electrode 81 may be disposed to cover the first lead-out portion 62 and extend from the third surface 103 of the body 50 to be disposed on the first surface 101, but is not disposed on the fifth surface 105 and the sixth surface 106 of the body 50. The second external electrode 82 may be disposed to cover the second lead-out portion 64 and extend from the third surface 103 of the body 50 to be disposed on the second surface 102, but is not disposed on the fifth surface 105 and the sixth surface 106 of the body 50.

Fourth Embodiment

Figure 7:
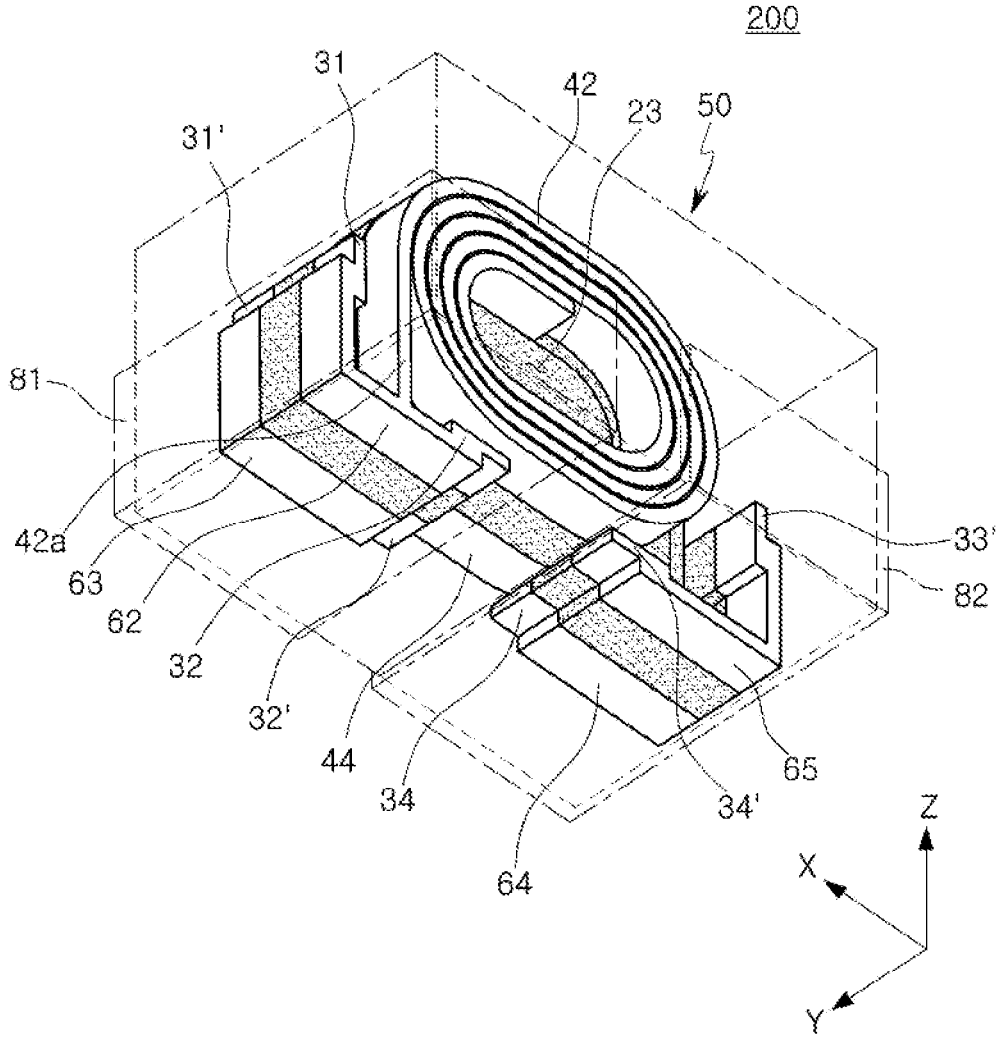
FIG. 7 is a view of a coil electronic component according to a fourth exemplary embodiment, viewed from below.
Figure 8:
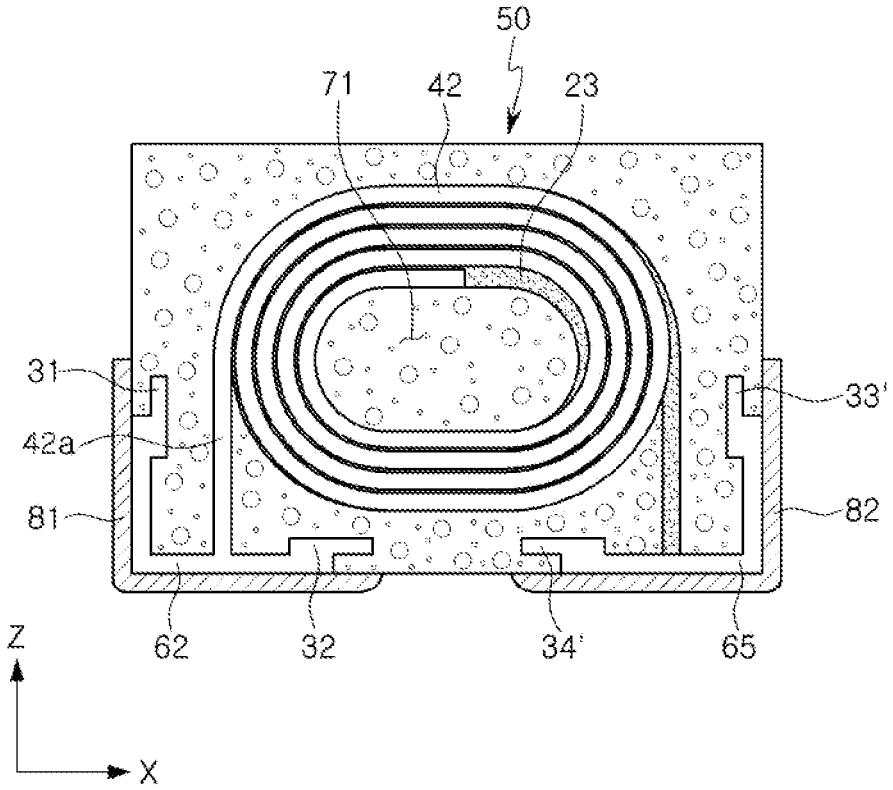
FIG. 8 is a view of a coil portion of the coil electronic component of FIG. 7, viewed from the front.

FIG. 7 is a view of a coil electronic component according to a fourth exemplary embodiment of the present disclosure, viewed from below. FIG. 8 is a view of a coil portion of the coil electronic component of FIG. 7, viewed from the front.

Referring to FIGS. 7 and 8, the presence or absence of auxiliary lead-out portions 63 and 65 is different compared with the coil electronic component 100 according to the third embodiment. Therefore, in describing a coil electronic component 20 according to this embodiment, only the presence or absence of the auxiliary lead-out portions 63 and 65 different from those of the third embodiment will be described. Descriptions of remaining configurations in this embodiment may be substituted with the descriptions of the third embodiment.

The auxiliary lead-out portions 63 and 65 (first and second auxiliary lead-out portions 63 and 65) are disposed on at least one surface of the insulating substrate 23 to correspond to the lead-out portions 62 and 64, respectively. In detail, the first auxiliary lead-out portion 63 is disposed on the other surface of the insulating substrate 23 and is formed to correspond to the first lead-out portion 62 disposed on one surface of the insulating substrate 23. The second auxiliary lead-out portion 65 may be disposed on one surface of the insulating substrate 23, and may be formed to correspond to the second lead-out portion 64 disposed on the other surface of the insulating substrate 23. By further including the auxiliary lead-out portions 63 and 65 having a symmetrical shape with the lead-out portions 62 and 64, the external electrodes 81 and 82 may be further symmetrically formed by plating in the coil electronic component 200 according to this embodiment. As a result, the coil electronic component 200 according to this embodiment may be more stably connected to a mounting substrate.

Referring to FIGS. 7 and 8, the external electrodes 81 and 82 and the coil portions 42 and 44 may be connected through the lead-out portions 62 and 64 and the auxiliary lead-out portions 63 and 65 disposed in the body 50. The auxiliary lead-out portions 63 and 65 may be electrically connected to the lead-out portions 62 and 64 by vias (not illustrated), and may be directly connected to the external electrodes 81 and 82. Since the auxiliary lead-out portions 63 and 65 are connected to the external electrodes 81 and 82, adhesion strength between the external electrodes 81 and 82 and the body 50 may be improved. The body 50 includes an insulating resin and a magnetic metal material, and the external electrodes 81 and 82 include a conductive metal, and thus are composed of different materials so that they do not tend to be mixed. Therefore, the auxiliary lead-out portions 63 and 65 are formed inside the body 50 to be exposed to the outside of the body 50, such that the external electrodes 81 and 82 and the auxiliary lead-out portions 63 and 65 may be additionally connected. Since the connection between the auxiliary lead-out portions 63 and 65 and the external electrodes 81 and 82 is a junction between a metal and a metal, the bonding force thereof is stronger than that between the body 50 and the external electrodes 81 and 82, such that adhesion strength of the external electrodes 81 and 82 to the body 50 may be improved.

Referring to FIG. 8, protrusions 31', 32', 33' and 34' are formed on the first and second auxiliary lead-out portions 63 and 65, respectively. Coupling force between the body 50 and the lead-out portions 62 and 64 and the auxiliary lead-out portions 63 and 65 may be improved through first and second protrusions 31' and 32' disposed on the first auxiliary lead-out portion 63, and third and fourth protrusions 33' and 34' disposed on the first auxiliary lead-out portion 65.

The auxiliary lead-out portions 63 and 65 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto.

As set forth above, in a coil electronic component according to an embodiment, connection reliability and structural rigidity of a portion in which a coil portion and an external electrode are connected may be increased.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A coil electronic component comprising:

an insulating substrate;

a coil portion disposed on at least one surface of the insulating substrate;

a body in which the insulating substrate and the coil portion are embedded;

a lead-out portion having a first portion extending from one end of the coil portion, the first portion including an end exposed to an external surface of the body, the lead-out portion further having a second portion bent at the exposed end of the first portion and extending along the external surface of the body while being exposed to the external surface of the body; and a protrusion embedded in the body, protruding from one end of the second portion, and spaced apart from the external surface of the body and from the coil portion.

2. The coil electronic component of claim 1, wherein the protrusion is spaced apart from each of all external surfaces of the body.

3. The coil electronic component of claim 1, wherein all surfaces of the protrusion, except a surface of the protrusion connected to the lead-out portion, are surrounded by the body.

4. The coil electronic component of claim 1, wherein the protrusion is disposed on at least one of both ends of the lead-out portion in a width direction of the body.

5. The coil electronic component of claim 1, wherein the protrusion includes a plurality of protrusions.

6. The coil electronic component of claim 1, further comprising an auxiliary lead-out portion disposed on another surface of the insulating substrate opposite the at least one surface to correspond to the lead-out portion.

7. The coil electronic component of claim 1, further comprising an external electrode disposed on the external surface of the body to cover the lead-out portion.

8. The coil electronic component of claim 6, wherein the protrusion is spaced apart from the external electrode.

9. The coil electronic component of claim 1, a length of the lead-out portion, in a width direction of the body, exposed to the external surface of the body is smaller than a width of the body.

10. A coil electronic component comprising:

a body having both end surfaces, opposing each other in a length direction of the body, and one surface connecting the both end surfaces to each other;

an insulating substrate disposed in the body;

a coil portion disposed on at least one surface of the insulating substrate;

a lead-out portion having a first portion extending from one end of the coil portion, the first portion including an end exposed to the one surface of the body, the lead-out portion further having a second portion bent at the exposed end of the first portion and extending along the one surface and the both end surfaces of the body while being exposed to the both end surfaces in the length direction and the one surface of the body in a thickness direction of the body; and a protrusion embedded in the body, protruding from one end of the second portion, and spaced apart from the both end surfaces and the one surface of the body and from the coil portion.

11. The coil electronic component of claim 10, wherein all surfaces of the protrusion, except for a surface of the protrusion connected to the lead-out portion, are surrounded by a magnetic material.

12. The coil electronic component of claim 10, wherein the protrusion is disposed on at least one of both ends of the lead-out portion in the length direction and the thickness direction of the body.

13. The coil electronic component of claim 10, wherein the protrusion includes a plurality of protrusions.

14. The coil electronic component of claim 10, further comprising an auxiliary lead-out portion disposed on another surface of the insulating substrate opposite the at least one surface to correspond to the lead-out portion.

15. The coil electronic component of claim 10, further comprising an external electrode covering the lead-out portion, wherein the protrusion is spaced apart from the external electrode.

16. A coil electronic component comprising:

an insulating substrate;

a coil portion disposed on at least one surface of the insulating substrate; and a body in which the insulating substrate and the coil portion are embedded, wherein the coil portion includes first and second lead-out portions each having a first portion extending from one end of the coil portion, the first portions of the first and second lead-out portions include one ends exposed to first and second surfaces of the body, respectively, opposing each other, each of the first and second lead-out portions further having a second portion bent at the exposed one end of the first portion and extending along the first or second surface of the body while being exposed to the first or second surface of the body, and at least one end of each of the second portions has a protrusion that protrudes inwardly of the body from a respective surface of the first and second surfaces to be spaced apart therefrom.

17. The coil electronic component of claim 16, wherein all surfaces of the at least one end of each of the first and second lead-out portions, except a surface thereof connected to a respective one of the first and second lead-out portions, are surrounded by a magnetic material of the body.

18. A coil electronic component comprising:

a body having first and second surfaces, opposing each other, and a third surface connecting the first and second surfaces to each other;

an insulating substrate; and a coil portion disposed on at least one surface of the insulating substrate, wherein the insulating substrate and the coil portion are embedded in the body, the coil portion includes first and second lead-out portions each having a first portion extending from one end of the coil portion and a second portion connected to the first portion, the first portion of the first lead-out portion includes a first end exposed to the third surface of the body, and the second portion of the first lead-out portion is bent at the first exposed end of the first portion of the first lead-out portion and extends along the first and third surfaces of the body while being exposed to the first and third surfaces of the body, the first portion of the second lead-out portion includes a second end exposed to the third surface of the body, and the second portion of the second lead-out portion is bent at the second exposed end of the first portion of the second lead-out portion and extends along the second and third surfaces of the body while being exposed to the second and third surfaces of the body, at least one end of the second portion of the first lead-out portion has a first protrusion that protrudes inwardly of the body from the first surface or the third surface to be spaced apart therefrom, and at least one end of the second portion of the second lead-out portion has a second protrusion that protrudes inwardly of the body from the second surface or the third surface to be spaced apart therefrom.

19. The coil electronic component of claim 18, wherein all surfaces of the at least one end of the first lead-out portion, except a surface thereof connected to the first lead-out portion, are surrounded by a magnetic material of the body, and all surfaces of the at least one end of the second lead-out portion, except a surface thereof connected to the second lead-out portion, are surrounded by a magnetic material of the body.

* * * * *